US006786251B2

(12) United States Patent
Nadel et al.

(10) Patent No.: US 6,786,251 B2
(45) Date of Patent: Sep. 7, 2004

(54) METHOD AND APPARATUS FOR GENERATING BUBBLES

(76) Inventors: Craig P. Nadel, 20 Tomalyn Hill Rd., Montville, NJ (US) 07045; Hans R. Bronner, 119 Brookside Ave., Irvington, NJ (US) 07111

( * ) Notice: Subject to any disclaimer, the term of this patent is extended or adjusted under 35 U.S.C. 154(b) by 0 days.

(21) Appl. No.: 10/633,153

(22) Filed: Jul. 31, 2003

(65) Prior Publication Data

US 2004/0094228 A1 May 20, 2004

Related U.S. Application Data

(60) Provisional application No. 60/400,227, filed on Aug. 1, 2002.

(51) Int. Cl.[7] ..... B65B 1/04
(52) U.S. Cl. ..... 141/98; 446/15
(58) Field of Search ..... 141/98, 286, 392; 446/15–21

(56) References Cited

U.S. PATENT DOCUMENTS 2,587,895 A * 3/1952 Quinn, Jr. et al. ..... 446/20
2,711,612 A * 6/1955 Wister ..... 446/20
4,276,713 A 7/1981 Crosbie
5,238,437 A * 8/1993 Vowles et al. ..... 446/15

* cited by examiner

*Primary Examiner*—Steven O. Douglas
(74) *Attorney, Agent, or Firm*—Cohen, Pontani, Lieberman & Pavane

(57) ABSTRACT

A method and apparatus for generating and emitting a continuous stream of bubbles formed from a supply of bubble liquid directs a first airstream into a supply of bubble liquid to create a froth of bubble liquid in a chamber, directs a second airstream against the froth in the chamber to drive the froth from the chamber through an exit chimney so that a film of the driven bubble liquid froth becomes attached to the exit chimney and the second airstream directed against the attached film creates and inflates a bubble attached to the exit chimney, and directs a third airstream peripherally about the exit chimney to facilitate detachment from the exit chimney of the created and inflated bubble attached to the exit outlet and displacement of the detached bubble away from the exit outlet. A self-contained apparatus incorporates a user-operable generator for creating a primary airstream which is redistributed to form the first, second and third airstreams.

20 Claims, 7 Drawing Sheets

METHOD AND APPARATUS FOR GENERATING BUBBLES

RELATED APPLICATIONS

This application claims priority from U.S. Provisional Application Serial No. 60/400,227, filed Aug. 1, 2002 and entitled Bubble Emitting Device and Method, the entire disclosure of which is incorporated herein by reference.

BACKGROUND OF THE INVENTION

1. Field of the Invention

The present invention relates to methods and apparatus for the production and emission of one or more streams of bubbles.

2. Description of the Related Art

In the quest to amuse young and old alike, numerous methods and structures have been developed as toys and recreational devices for the production of bubbles. The bubble, with its unique form and appearance, has long fascinated both its creators and observers. It has a structure so pure in shape and strength that for centuries physicists and nonscientists alike have marveled at its mere existence. The way in which bubbles have been produced throughout history has been a study that has been approached with great care and diligence.

Bubbles have most traditionally been produced by placing a wicking device into a solution of soap and glycerin and then forcing gas into or against the attached film that covers the expanse of the wick. In its simplest form, a stick or rod formed with an enlarged opening or port at one end is dipped into a supply of a soapy liquid, and the user blows gently through the opening against the attached film of soapy liquid that is contained within the opening. This causes the film to stretch and inflate and, eventually, close upon itself, producing a spherical, formed soap bubble that is driven by the continuing stream of gas away from the wick on which it was formed.

However, such traditional bubble producing methods and devices require multiple steps, i.e. dipping the wick into bubble solution and then blowing on the wick or wand, and thereafter repeating the same operations again and again. In addition, these operations often fail to produce a significant number of bubbles in each attempt, and thus require that the user repeatedly dip the wick in the supply of bubble solution and blow on or against the wick-attached film in order to generate even a modest volume of bubbles. Further, the necessary repeated dipping of the wick into the bubble solution is typically a very messy process resulting in dripping and spillage of the bubble solution on the user and the user's surroundings.

OBJECTS AND SUMMARY OF THE INVENTION

It is accordingly a principal object of the invention to provide a bubble generating and emitting method and apparatus that produces a significant volume of bubbles.

It is another object of the invention to provide a bubble generating and emitting method and apparatus that produces a continuous stream or streams of bubbles in a single step, as for example automatically with the continued actuation of an operating switch.

It is a further object of the invention to provide a bubble generating and emitting method and apparatus that does not require the use of a messy wick or manual or repeated dipping of an instrument into a supply of bubble solution.

The present invention advantageously employs an air flow distribution process and system implemented in a bubble generating and emitting assembly to produce a significant volume and continuous stream(s) of bubbles with just the press of a user-actuatable operating button. In a particularly preferred embodiment of the invention as herein depicted and described, the bubble generating and emitting assembly of the invention diverts portions of an air flow within the device into three separate streams of varying strength and intensity to:

a) create pre-bubble froth or foam or film from a stored supply of bubble liquid;

b) drive the pre-bubble froth or film through tubes or chimneys and inflate the froth or film that attaches to the exit lips of the chimneys to form bubbles; and c) create an updraft around the outer periphery of the bubble-emitting chimneys to effect and facilitate release and emission of the bubbles from the outer periphery of the chimneys and away from the assembly.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are primarily intended to conceptually illustrate the structures and procedures described herein.

BRIEF DESCRIPTION OF THE DRAWINGS

In the drawings.

In the drawings, wherein like reference characters denote similar elements throughout the various Figures.

DETAILED DESCRIPTION OF THE PRESENTLY PREFERRED EMBODIMENTS

Figure 1:
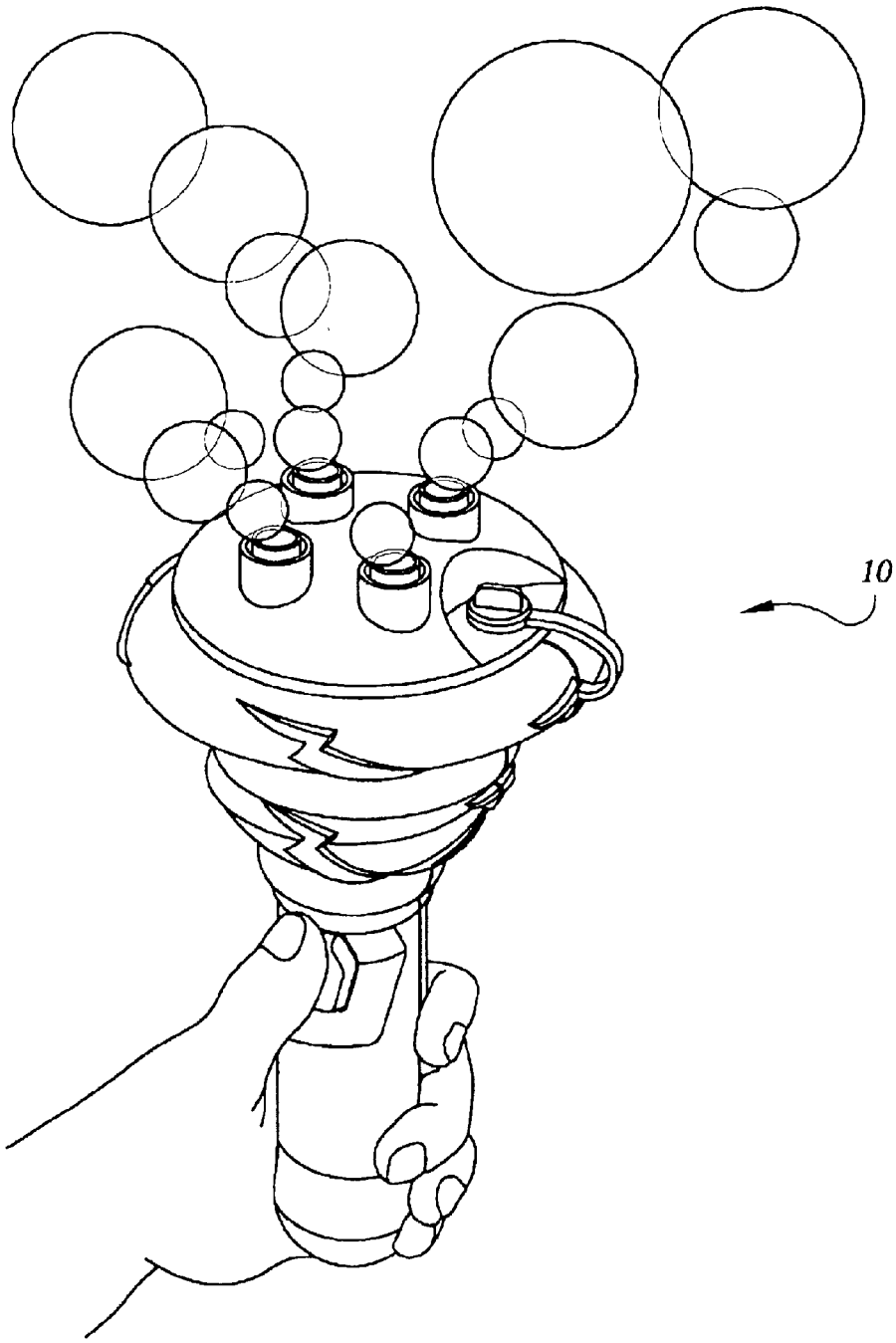
FIG. 1 is an elevated perspective view of a handheld bubble generating and emitting device, manually actuated by a user for operative use of the device, constructed in accordance with the present invention.
Figure 2:
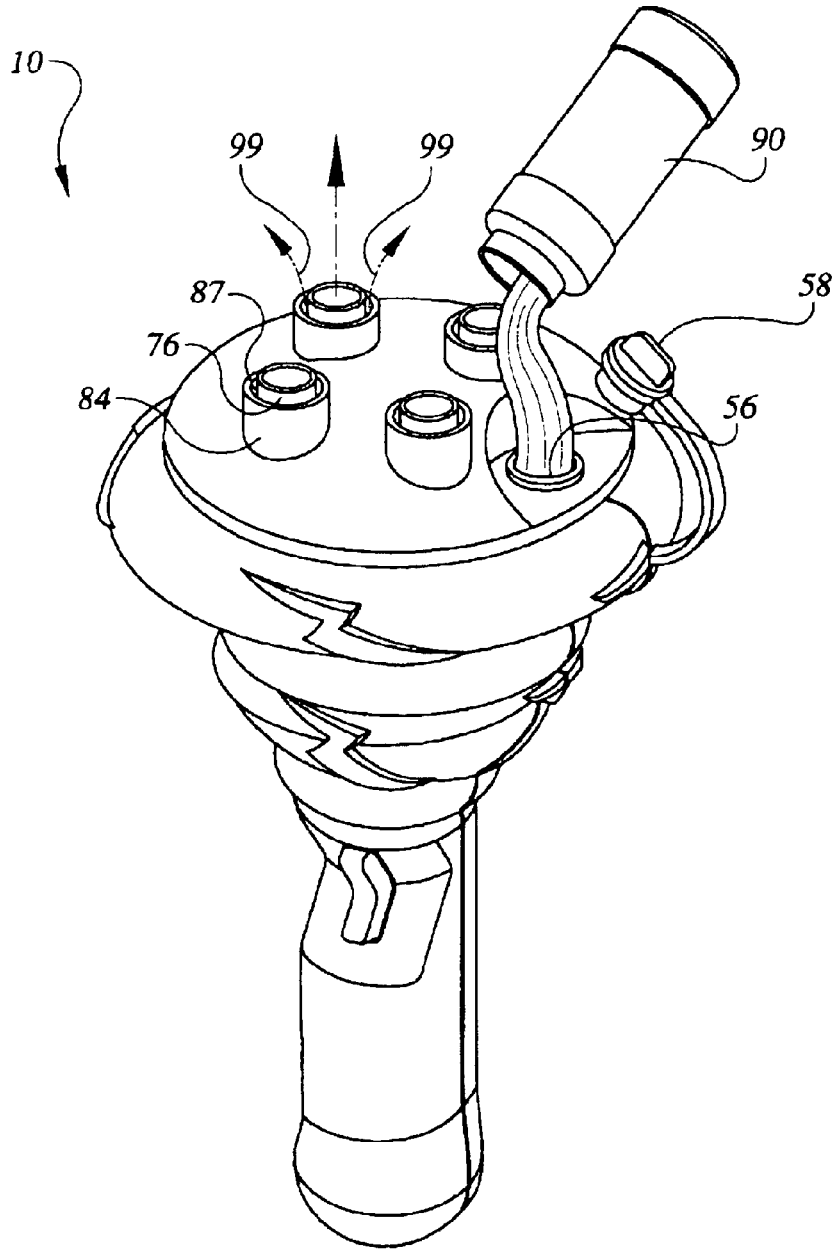
FIG. 2 is an elevated perspective view of the handheld device of FIG. 1, depicting the process of filling of the internal reservoir with bubble liquid.

The currently-preferred apparatus embodiment of the invention shown in FIGS. 1 and 2 is in the form of a handheld bubble generating and emitting device identified by the general reference numeral 10. Those skilled in the art and having knowledge of this disclosure will nevertheless recognize and appreciate that the invention need not be and, indeed, is not intended to be limited to a handheld implementation, or for that matter to any particular physical construction or actuating or operating mechanism or arrangement except as otherwise necessary to practice the invention as set forth in the claims hereof. Thus, by way of purely illustrative example, the bubble generating and emitting device may be constructed as a freestanding assembly supportable on a tabletop or directly on an underlying ground surface, and appropriately sized to emit a desired continuous or predeterminately intermittent volume of bubbles in a single or predetermined multiplicity of streams. Likewise, and as will be further understood as this description proceeds, the mechanism by which an operating airstream is produced to generate and effect the emission of bubbles may take the form of an electric motor actuated by a user-manipulatable switch—as in the embodiment herein shown and described—or a manually-driven airstream producer, or a mechanism powered by any source or means of energy, whether as a part of a bubble generating device or as an unrelated generator from which a single or multiple airstreams are directed to the device, as a general matter of the intended application and design choice. These and all other such modifications are within the fully intended scope and contemplation of the invention.

The key to the present invention lies in the manner in which the bubbles are generated and emitted. An incoming airstream—which, in the embodiment herein described and illustrated is produced by an electric motor-driven fan—is split or divided into three parts or substreams. The first substream is injected into or through a contained supply of bubble liquid to create a froth of interleaved, overlapping, typically arcuate films or film sections of the liquid in a chamber—much in the way in which a child, blowing into a straw whose far end is submerged in a cup of milk or the like, creates a surface froth of interleaved and overlapping milk films that, with continued blowing into the straw, increases in volume and, eventually, spills out above and behind the rim of the cup. The second substream drives the froth into one or more outlet or exit chimneys; as the froth film reaches the chimney's exit lip, it becomes attached at the exit lip and forms a bubble that expands under the continued urgency of the second substream—similar to the way in which a bubble is formed from a liquid film "stretched" across a bubble wand opening when the user blows against the film. The third substream is directed outward about the immediate periphery of the exit chimney to facilitate disengagement and release of the bubble from the exit chimney—i.e. to "lift" the bubble from the chimney lip on which it has been formed and carry it away from the exit chimney. In the particular apparatus embodiment of the invention herein shown and described by way of illustrative example, the functionality provided by the multiple air substreams is supplied by the generator assembly which is constructed of a plurality of stacked elements, as hereinafter described.

Figure 3:
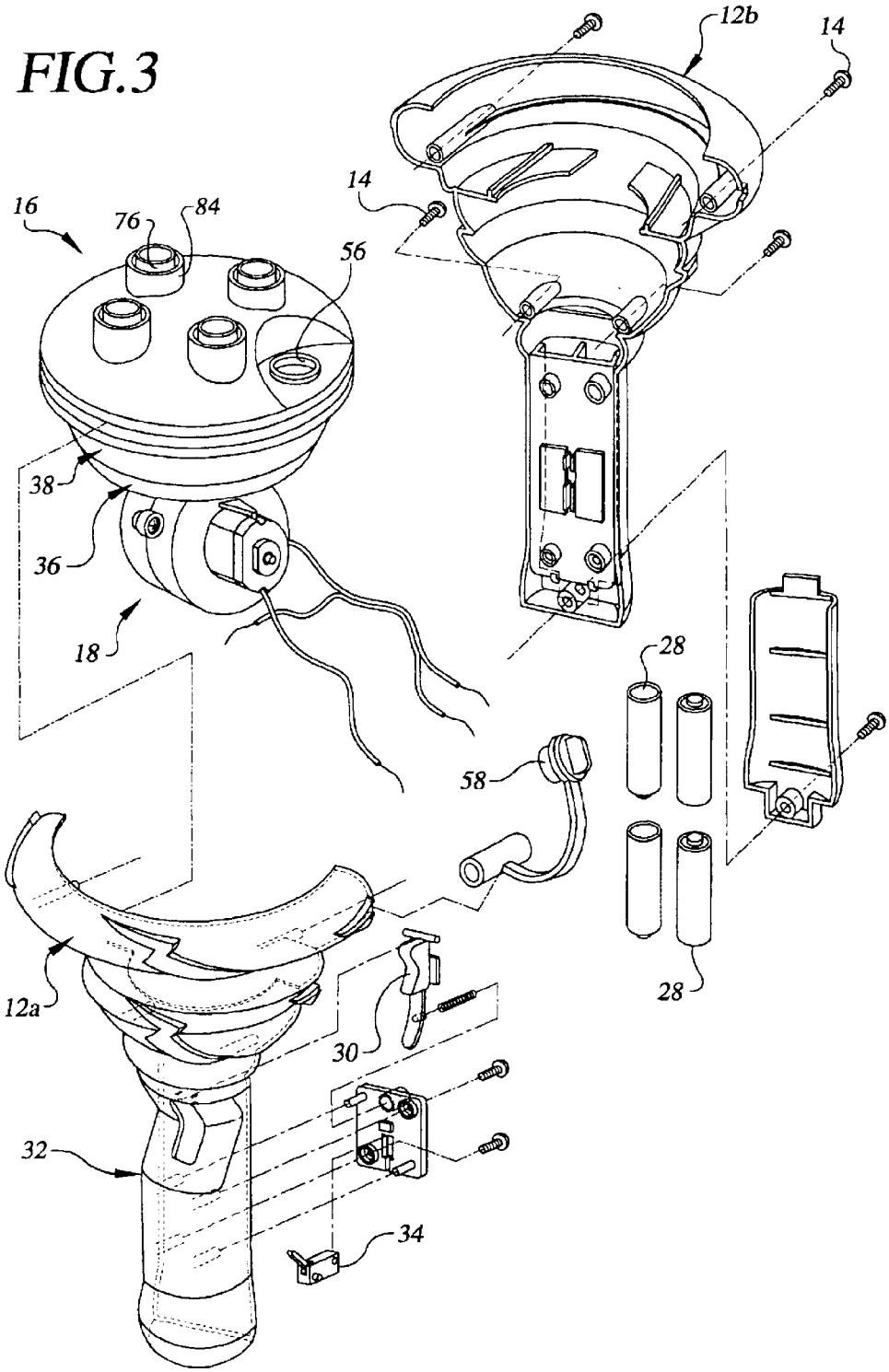
FIG. 3 is an elevated perspective exploded view of the handheld device of FIG. 1.
Figure 4:
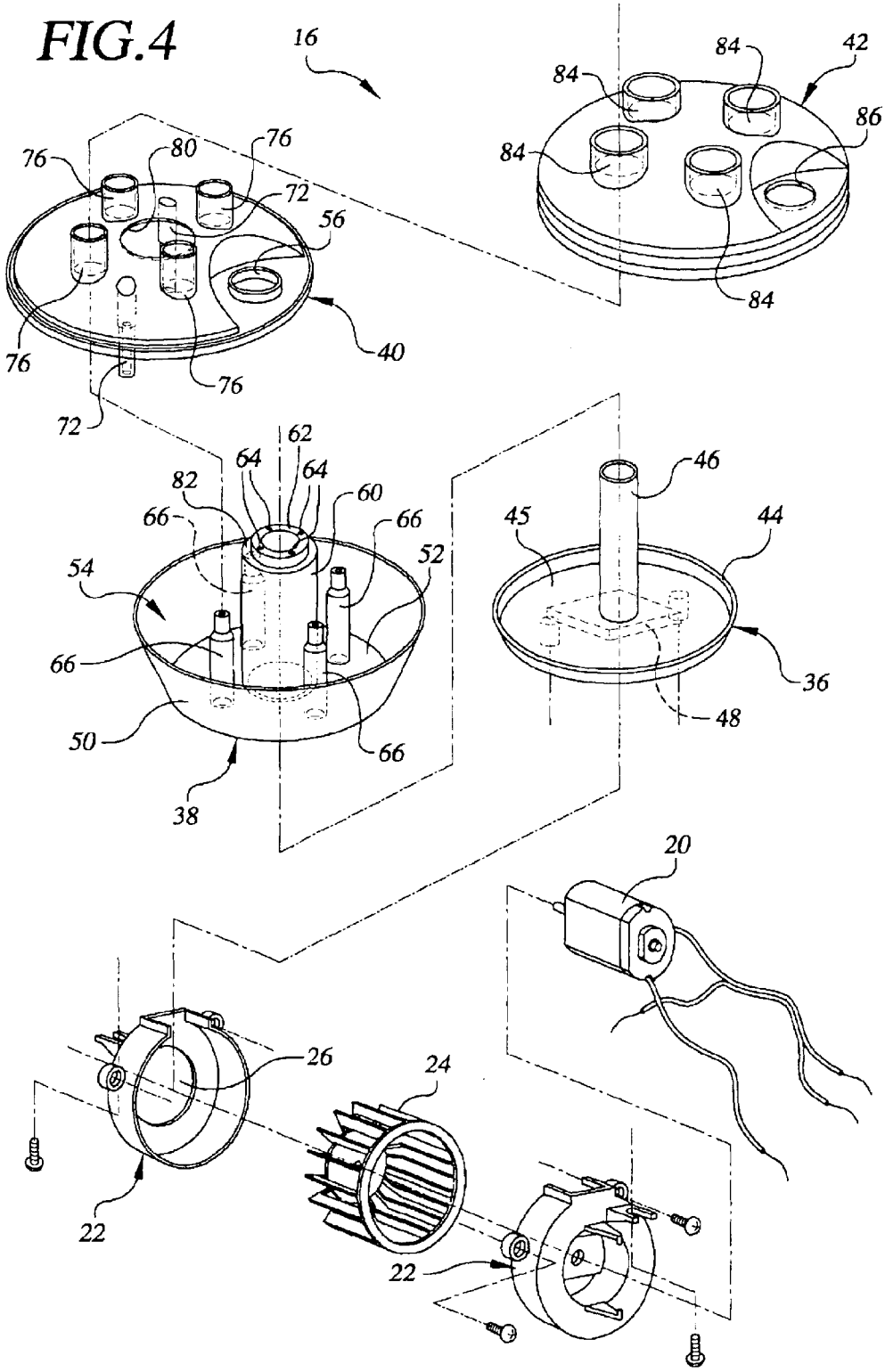
FIG. 4 is another elevated perspective exploded view of the handheld device of FIG. 1, depicting in particular the construction of the bubble generating assembly of the illustrated device.
Figure 5:
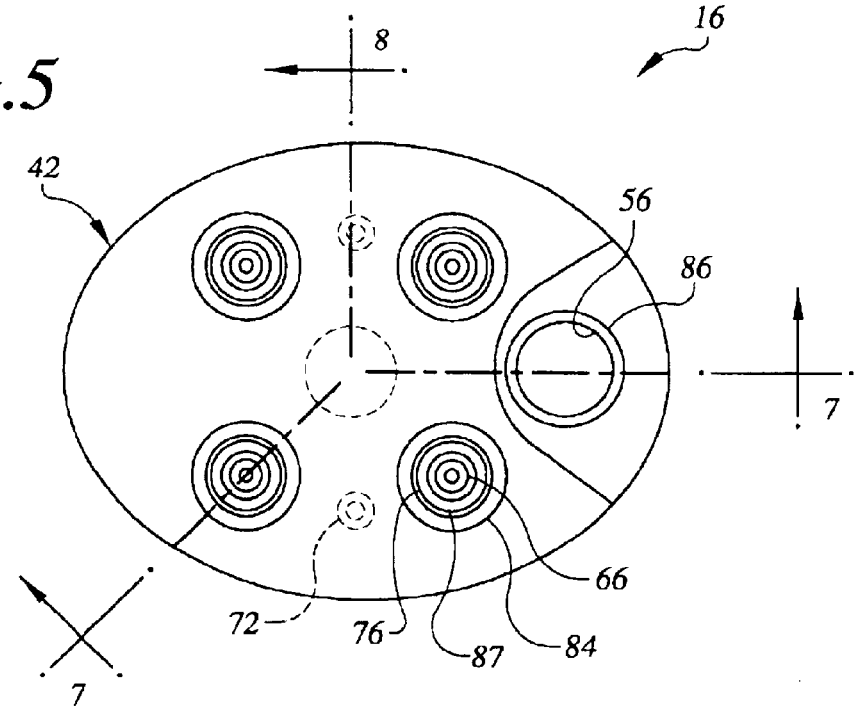
FIG. 5 is a top plan view of the handheld device of FIG. 1.
Figure 6:
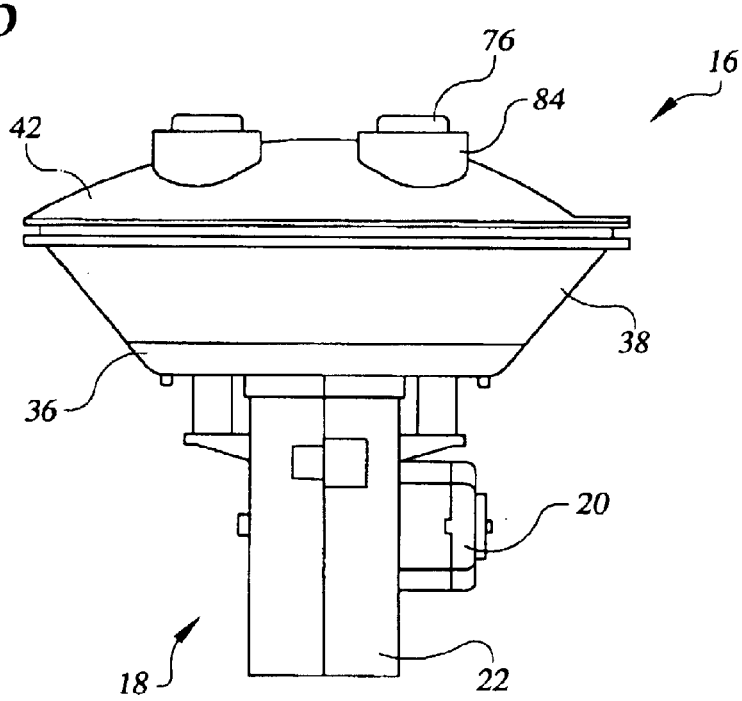
FIG. 6 is a side view of the bubble generating assembly and attached primary airstream generator assembly of the handheld device of FIG. 1.

As perhaps best seen in FIG. 3, the device 10 is formed of a plurality of components generally contained within the assembled bifurcated housing halves 12*a*, 12*b*, which may for example be held together by screws 14. Housing 12 captively encloses the bubble generator assembly 16 and an attached primary airstream generator 18. As seen in FIG. 4, the airstream generator 18 in the herein-disclosed handheld device 10 is formed of an electrically-operated motor 20 contained within a motor housing 22 and whose motor shaft carries a bladed impeller fan 24 for creating the primary airstream using ambient air drawn into the device housing 12 through an intake opening 26 defined in motor housing 22. Electric power from batteries 28 receivable within the device housing 12 is supplied to motor 20 by selective actuation of a user-manipulatable rocker switch member 30 that partly protrudes through a reduced-radius handgrip region 32 of the device housing 12 and which operates a switch 34 connected by suitable electrically conductive leads or wires or the like to the batteries 28 and motor 20.

The construction details of the bubble generator 16 of the handheld device 10 is shown in the exploded format of FIG. 4. The generator 16 is constructed in this implementation of the invention by four stacked elements that variously define the passageways and chambers and conduits with which the primary airstream from the airstream generator assembly 18 is directed through the bubble generator assembly 16 in which the several substreams are formed and directed to create and effect outwardly-propelled emission of bubbles from the device 10. These four elements are, for convenience of illustration and description, referred to herein as the base 36, the liquid tray 38, the riser 40, and the cover 42. Each of the members 36, 38, 40 and 42 in the depicted handheld device 10 have a generally circular cross-section but may of course be differently shaped, contoured and/or configured as a general matter of design choice, requiring only that the various members that form the bubble generator 16—whether four such members (as herein shown) or any number of members or elements or assemblies or subassemblies of which the generator 16 is constructed—provide the appropriate operative functionality to generate and emit bubbles in accordance with the invention.

Base 36 has a peripheral sidewall 44 that rises from the base floor 45 to form a shallow tray from which an upwardly extending hollow tube 46 projects. The opposite side (i.e. the bottom surface, in the drawings) of base 36 may as shown carry a positioning ridge 48 or other surface feature that mates with corresponding structure or surfaces of the motor housing 22 to properly locate the motor assembly so that the primary airstream operatively generated by the airstream generating module 18 is directed upwardly (in the drawings) through the primary airstream feed tube 46. It should at this point be noted that references in this description to particular orientations —such as up vs. down, or vertical vs horizontal—are used solely to assist in an understanding of the invention as implemented in the handheld device 10 as shown in the drawings and are not, unless otherwise expressly indicated, intended to denote a limitation on the scope of the invention or any required or contemplated orientation of a bubble generating and emitting method and/or apparatus of the invention.

The liquid tray 38 has a sidewall 50 that rises from its floor 52 to define a reservoir 54 for holding a supply of liquid from which the device 10 operatively generates bubbles for emission or release in one or more bubble streams. Bubble liquid—which may as a matter of design choice be of any composition or components suitable for creating bubbles as herein discussed and/or as well known in the art, and which forms no part of the present invention—is fed into the reservoir 54 through an inlet port 56 (see FIG. 2) which, except as liquid is being supplied to the reservoir, is normally closed by a manually-disengageable plug 58 or the like. A hollow redistribution tube 60 depends upwardly from the liquid tray floor 52 and, at its top (i.e. that end most remote from the liquid tray floor 52), carries a radially-inwardly directed shelf 62 in which a plurality of bores 64 are defined. The liquid tray floor 52 also carries four, in the illustrated embodiment, hollow updraft chimneys 66 which project upwardly to a distance beyond the peripheral rim of the sidewall 50.

Figure 7:
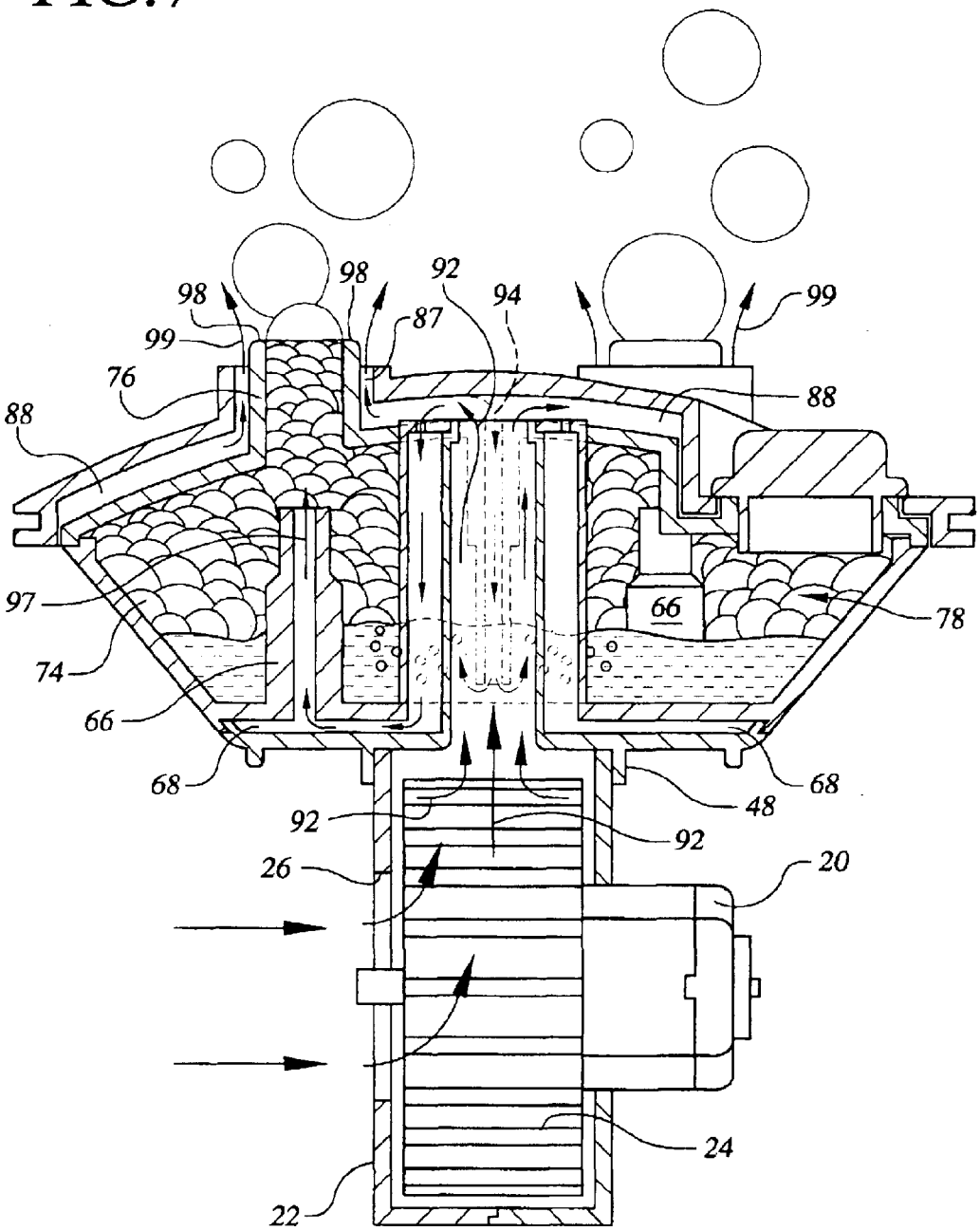
FIG. 7 is a cross-sectional view taken along the lines 7—7 in FIG. 5.
Figure 8:
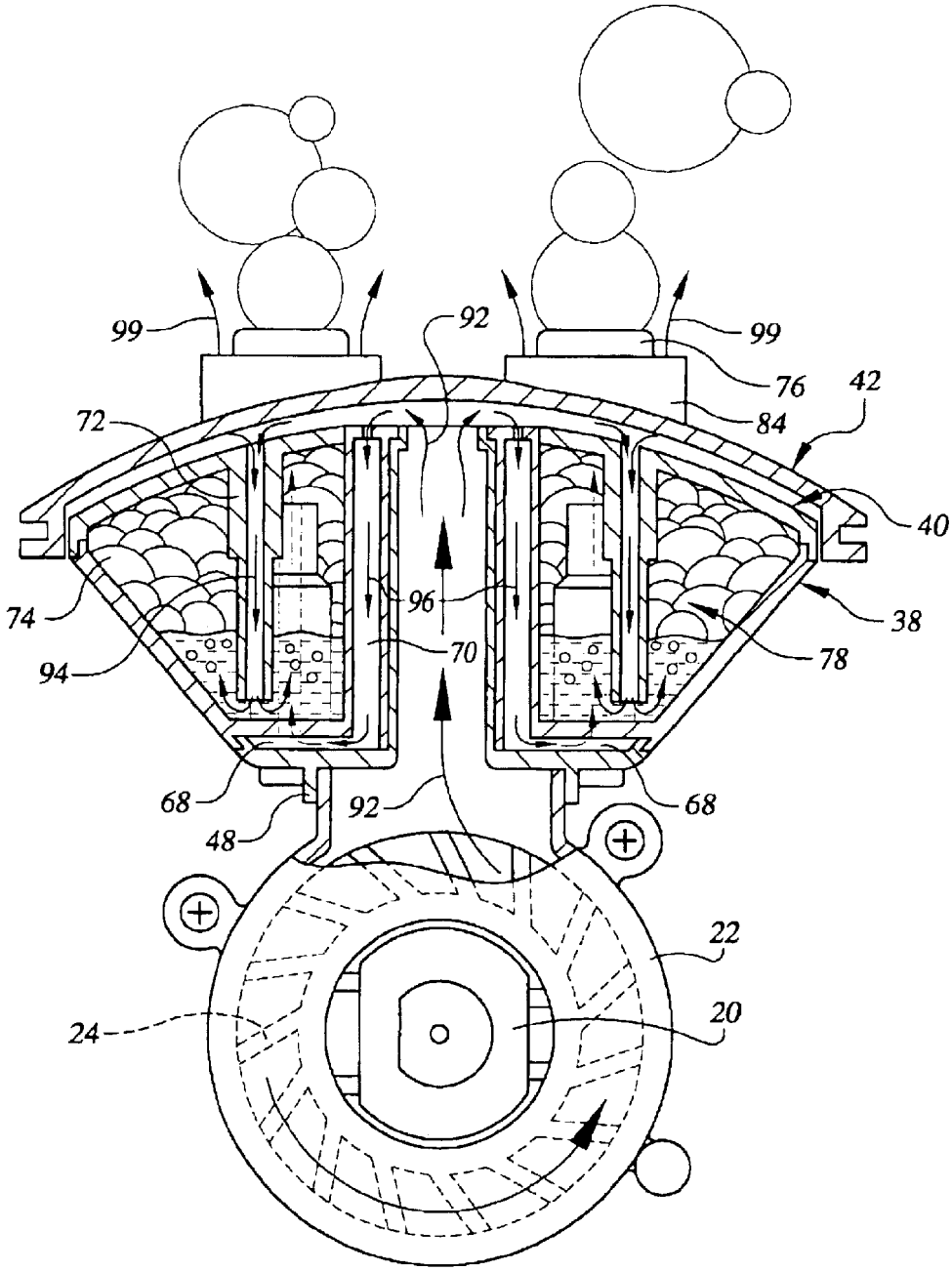
FIG. 8 is a cross-sectional view taken along the lines 8—8 in FIG. 5.

When the base 36 and liquid tray 38 are nestedly engaged in the assembled condition of the currently-preferred construction of the operable bubble generator 16, as seen in FIGS. 7 and 8, a second substream chamber 68 is defined between the base floor 45 and the underside of the liquid tray floor 52. The second substream chamber 68 communicates with the interior of the hollow updraft chimneys 66. Also as a result of the nested engagement of the base 36 and liquid tray 38, and by virtue of the placement and sizings of the feed tube 46 and redistribution tube 60, feed tube 46 is disposed concentrically within redistribution tube 60 to define therebetween a second substream redistribution conduit 70 bounded by the respective walls of the concentrically-disposed tubes 46, 60 and that communicates with the second substream chamber 68 and, therethrough, with updraft chimneys 66. Conduit 70 is substantially closed at its upper (in the drawings) end by the shelf 62 which is radially sized to extend between the concentrically spaced-apart tubes 46, 60 and thereby close conduit 70 to airflow communication through the top of conduit 70 except as through the bores 64 in shelf 62.

Riser member 40 carries a pair (in the illustrated device 10) of hollow first substream bubbler tubes 72 that project, in the assembled condition of the bubble generator 16, into the liquid reservoir 54 to a distance sufficient to place the free ends of the tubes 72 below the surface of bubble liquid contained in the reservoir. As hereinafter described in connection with the operation of the device 10, an air substream directed through each of the bubble tubes 72 into the bubble liquid contained in reservoir 54 generates a froth or foam 74 comprised of interleaved, overlapping films of the bubble liquid, as can be seen in FIGS. 7 and 8. Riser member 40 also carries, on its surface opposite that from which the bubbler tubes 72 project, four (in the illustrated device 10) hollow exit chimneys 76 that extend upwardly or away from their support surface and through which bubbles generated by the device 10 are discharged therefrom. An opening 80 sized and shaped to fit snuggly about redistribution tube 60 in the assembled condition of the bubble generator 16 is additionally defined in riser member 40. Redistribution tube 60 may be provided, adjacent shelf 62, with a lip or ledge 82 for assuring a fluid-tight fit between the periphery of opening 80 and redistribution tube 60.

When the riser member 40 is nestedly engaged with the liquid tray 38 in the assembled condition of the operable bubble generator 16, as seen in FIGS. 7 and 8, the so nested members form therebetween a chamber that includes the liquid reservoir 54 and that also receives and contains the froth 74 generated during operation of the device 10. The chamber 78 is, through the exit chimneys 76, in communication with the ambient air. By virtue of the placement of the updraft chimneys 66 on liquid tray member 38 and of the exit chimneys 76 on riser member 40, and as seen in FIG. 7, in the preferred embodiment shown in the drawings each updraft chimney 66 is substantially aligned with a corresponding one of the exit chimneys 76. In addition, and as shown in FIG. 8, the bubbler tubes 72 are disposed between adjacent ones of the updraft chimneys 66.

The cover member 42 carries four—in the illustrated device 10—hollow lift chimneys 84 that project upwardly from the outer surface of member 42. The lift chimneys 84 are located and sized for concentric spaced-apart disposition, in the assembled condition of bubble generator 16, of each lift chimney 84 about a respective one of the exit chimneys 76. Each pair of concentric chimneys 76, 84 thereby defines a third substream lift conduit 87 bounded by the confrontingly opposed, spaced-apart walls of the concentric chimneys. In preferred forms of the invention the exit chimneys 76 are further sized to extend upwardly (in the drawings) beyond the ends of the lift chimneys 84. Cover member 84 also includes a feed opening 86 defined to align with liquid inlet port 56 to accommodate through the aligned openings 56, 86 the introduction of bubble liquid into the liquid reservoir 54.

As seen in FIGS. 7 and 8, when the riser member 40 and cover member 42 are nestedly engaged in the assembled condition of bubble generator 16, an airstream distribution chamber 88 is defined between the members 40, 42. The chamber 88 communicates with the interior of the primary airstream feed tube (through which the primary airstream is communicated into the bubble generator assembly 16 from motor assembly 18), with the first substream redistribution conduit (through the bores 64 defined in the redistribution tube shelf 62), and with the ambient air (i.e. exteriorly of the device 10) through the third substream lift conduits 87.

Operation of the handheld bubble generating and emitting device 10 as shown in the drawings will now be described with particular reference to FIGS. 7 and 8. First, and preliminary to operation of the device to generate bubbles, a supply of bubble liquid, as for example from a bottle 90 or other storage container thereof, sufficient to at least partly fill the liquid reservoir 54 is poured into and through the aligned openings 56, 86 (FIG. 2). The resulting liquid level in reservoir 54 should submerse at least the open free ends of the bubbler tubes 72 without, however, submersing the open free ends of the updraft chimneys 66. The switch 34 is then actuated, as by selective user-manipulated depression or displacement of the rocker switch member 30, to power the motor 20 and thereby generate the primary airstream as the impeller fan 24 is rotated by the motor.

The primary airstream generated by the operating motor-powered fan is directed upwardly (in the drawings) through the hollow interior of feed tube 46 and into the airstream distribution chamber 88, as indicated by the arrows 92 in FIGS. 7 and 8. It is in the chamber 88 that the primary airstream generated by the motor/fan assembly 18 is split or divided or otherwise directed or distributed to form the three substreams of air by which bubbles are generated by and emitted and propelled from the device 10 in accordance with the invention.

A first portion of the primary airstream in chamber 88 is directed therefrom into and through the bubbler tubes 72 to form the first substream, as indicated by the arrows 94 in FIG. 8. The first substream exits the open free ends of the bubbler tubes, which are submersed within the supply of liquid in reservoir 54, and the exiting air of the first substream bubbles upward within the liquid. As the bubbles break the surface of the liquid, they form typically arcuate films that interleave and overlap and press against each other and, as the first substream continues to exit the bubbler tubes 72, build up to define a liquid film-based froth or foam 74 that increasingly fills the chamber 78.

A second portion of the primary airstream in chamber 88 is directed therefrom into the redistribution conduits 70 through the shelf bores 64, as indicated by the arrows 96, to form the second substream. As best seen in FIG. 7, the redistribution conduits direct the second substream into the second substream chamber 68, from which the substream air is further directed into and through the updraft chimneys 66. With the chamber 78 substantially filled (above the liquid reservoir surface level) with the froth or foam 74, the second substream air exiting the open free end of each updraft chimney 66 (see arrows 97) drives or otherwise urges the froth films toward and into the respective exit chimney 76 with which the updraft chimney is substantially aligned. Through this process a film of bubble liquid attaches to or is formed at the exit lip 98 of each exit chimney 76; the second substream air exiting the aligned updraft chimney 66, in addition to continuing to drive more of the froth 74 toward and into the exit chimney, in effect expands or inflates the attached film at the exit lip 98 and thereby forms a bubble on the exit lip, much in the manner that a user blowing into a liquid film attached to the free end of a conventional user-manipulated bubble wand similarly causes the film to form into and inflate an incipient bubble that initially remains attached to the wand.

A third portion of the primary airstream in distribution chamber 88 is directed therefrom into and through the lift conduits 87 which concentrically surround the exit chimneys 76, as indicated by the arrows 99, to form the third substream. As the third substream exits the lift conduits 87, it assists and facilitates detachment from the exit chimney lips 98 of the bubbles that have operatively formed and been inflated while attached to the exit chimneys. The third substream exiting the lift conduit additionally drives or urges the detached bubbles upward (in the drawings) away from the handheld device 10. As each bubble is thus detached and lifted or propelled away from a respective one of the exit chimneys 76, it is replaced on the chimney lip 98 by another liquid film that forms another bubble that is inflated and detached and then quickly replaced by still another liquid film on the exit lip 98, and so on with continued operation of the primary airstream generator 18. In this manner a continuous, high density stream of bubbles is rapidly generated and emitted from each exit chimney 76 of the handheld device 10, producing a virtual flurry of outwardly-propelled bubbles from the multiple exit chimneys with which currently preferred embodiments of the invention are provided.

Those skilled in the art will recognize that various operating characteristics of the handheld device 10 as herein shown and described may be selectively varied by adjusting, for example, the volume(s) of air used to create and effect the emission and propulsion of bubbles therefrom. In a currently preferred implementation of the device 10, approximately 10 percent (by volume) of the primary airstream is distributed from the chamber 88 to form the first substream that is directed through the bubbler tubes 72. Another approximately 10 percent of the primary airstream is distributed from the chamber 88 to form the second substream that is directed through the bores 64 into the redistribution conduit 70 and, finally, into and through the updraft chimneys 66. Finally, the remaining proximately 80 percent of the primary airstream is distributed from the chamber 88 to form the third substream that is directed into and through the lift conduits 87. These relative substream airflow volumes can be predeterminately varied—as for example by modifying the dimensions, configurations and/or geometries of the bores and passageways and exit lips and the like through which the primary airstream is distributed or directed to form the several substreams—to thereby change selected operating characteristics of the device 10, such as the size, density and volume of the bubbles produced by the inventive device, the velocity with which the bubbles are emitted or propelled from the device, and other characteristics as will be apparent to those of ordinary skill in the art. Modifying structural and/or operating characteristics of the motor and/or impeller fan to vary the volume of the primary airstream and the velocity at which it is delivered to the distribution chamber 88 will likewise affect the production and characteristics of bubbles emitted from the device 10.

It should also be understood that the use herein of the term "substreams" to identify the various air streams that effect the operative functionality of the inventive device—as herein disclosed and in any of a wide variety of possible modifications deemed to be within the intended scope and contemplation of the invention—should not be viewed as a limitation on the manner in which those airstreams are produced or any other characteristics thereof. It is intended that methods and apparatus implemented in accordance with the invention can, as in the disclosed handheld device 10, utilize a single primary airstream that is generated and then split or otherwise utilized to form therefrom a plurality of substreams or secondary streams or the like, or alternatively that several separate airstreams may be separately or individually generated and employed for their respective functions as for example herein described. The primary and/or second airstreams can moreover be generated within or as a part of a device constructed in accordance with the invention, or can be generated or obtained exteriorly or independently of the device and then directed to the device to supply their intended functionality or uses. Moreover, embodiments of the invention are contemplated in which different numbers—i.e. other than three—substreams or secondary airstreams are employed to implement the inventive functionality and utility of the invention. All such modifications should be understood as being within the intended scope and contemplation of the invention.

Thus, while there have shown and described and pointed out fundamental novel features of the invention as applied to preferred embodiments thereof, it will be understood that various omissions and substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An assembly for generating and emitting a continuous stream of bubbles formed from a supply of bubble liquid, said assembly comprising:

a reservoir for receiving and retaining a supply of bubble liquid;

a bubbler conduit for directing a first airstream into the supply of bubble liquid in the reservoir to create from the bubble liquid a froth of bubble liquid in a chamber defined in fluid communication with the reservoir;

an exit outlet in fluid communication with said chamber and having an outer periphery;

an updraft chimney disposed in fluid communication with the chamber for directing a second airstream against the froth to drive the froth into the exit outlet so that a film of the driven bubble liquid froth becomes attached to the exit outlet and the second airstream directed against the attached film creates from the attached film and inflates a bubble attached to the exit outlet; and a lift passageway defined proximate the exit outlet for directing a third airstream about the exit outlet periphery to facilitate detachment from the exit outlet of the created and inflated bubble attached to the exit outlet and displacement of the detached bubble away from the exit outlet.

2. An assembly in accordance with claim 1, wherein the exit outlet comprises an elongated exit chimney.

3. An assembly in accordance with claim 2, wherein the lift passageway is defined by a lift chimney disposed in spaced relation about the exit chimney periphery.

4. An assembly in accordance with claim 1, wherein the reservoir is contained within said chamber.

5. An assembly in accordance with claim 1, wherein said updraft chimney is disposed in substantial alignment with said exit outlet for directing the second airstream toward and into said exit outlet in a first direction, and wherein said lift passageway is oriented for directing the third airstream in said first direction.

6. An assembly in accordance with claim 1, further comprising a distribution chamber in fluid communication with the bubbler conduit, the updraft chimney and the lift passageway for receiving a primary airstream and directing a first portion of the received primary airstream to the bubbler conduit to define the first airstream, directing a second portion of the received primary airstream to the updraft chimney to define the second airstream, and directing a third portion of the received primary airstream to the lift passageway to define the third airstream.

7. An assembly in accordance with claim 6, further comprising a primary airstream generator in fluid communication with the distribution chamber for operatively generating the primary airstream.

8. An assembly in accordance with claim 1, further comprising an airstream generator in fluid communication with the bubbler conduit, the updraft chimney and the lift passageway for operatively generating the first, second and third airstreams.

9. A method of generating and emitting a first of a continuous stream of bubbles formed from a supply of bubble liquid, comprising the steps of:

directing a first airstream into a supply of the bubble liquid to create a froth of bubble liquid in a chamber;

directing a second airstream against the froth in the chamber to drive the froth from the chamber through an exit outlet in a first direction so that a film of the driven bubble liquid froth becomes attached to the exit outlet and the second airstream directed against the attached film creates from the attached film and inflates a bubble attached to the exit outlet; and directing a third airstream in the first direction and peripherally about the exit outlet to facilitate detachment from the exit chimney of the created and inflated bubble attached to the exit outlet and displacement of the detached bubble in the first direction away from the exit outlet.

10. A method in accordance with claim 9, further comprising the steps of:

receiving a primary airstream; and redistributing predetermined portions of the primary airstream to create the first airstream, the second airstream and the third airstream.

11. A method in accordance with claim 9, further comprising the steps of:

generating a primary airstream; and redistributing predetermined portions of the primary airstream to create the first airstream, the second airstream and the third airstream.

12. Apparatus for generating and emitting a continuous stream of bubbles formed from a supply of bubble liquid, said apparatus comprising:

a housing;

a reservoir in said housing for receiving a supply of bubble liquid;

a froth chamber defined in said housing in fluid communication with said reservoir;

a distribution chamber defined in said housing for receiving a primary airstream and for defining from the primary airstream a first air substream, a second air substream and a third air substream;

a bubbler passage defined in said housing in fluid communication with said distribution chamber for receiving the first air substream from the distribution chamber and configured for directing the first air substream into the bubble liquid in the reservoir to create a froth of bubble liquid in said froth chamber;

an exit outlet defined in said housing in fluid communication with said froth chamber, said exit outlet having an outer periphery;

an updraft passage defined in said housing in fluid communication with said distribution chamber for receiving the second air substream from the distribution chamber and configured for directing the second air substream against the froth in said froth chamber so as to drive the froth into the exit outlet such that a film of the second air substream driven bubble liquid froth becomes attached to the exit outlet and the second air substream directed against the attached film creates from the attached film and inflates a bubble attached to the exit outlet; and a lift passageway defined in the housing proximate the exit outlet for directing the third air substream outwardly from the housing about the exit outlet periphery to facilitate detachment from the exit outlet of the created and inflated bubble attached to the exit outlet and displacement of the detached bubble away from the exit outlet and housing.

13. An apparatus in accordance with claim 12, wherein said lift passageway is defined in concentrically spaced relation about the exit outlet.

14. An apparatus in accordance with claim 12, further comprising an airstream generator in said housing and operable for creating the primary airstream for receipt by said distribution chamber.

15. An apparatus in accordance with claim 13, wherein said housing comprises a handgrip portion graspable by a user, said apparatus further comprising a user-manipulatable actuator on said handgrip portion and connected to the airstream generator for selective user operation of the airstream generator to create the primary airstream and generate and emit from said apparatus a continuous stream of bubbles.

16. Apparatus for generating and emitting a continuous stream of bubbles formed from a supply of bubble liquid, said apparatus comprising:

a housing;

a froth chamber defined in said housing;

a reservoir in said froth chamber for receiving a supply of bubble liquid;

an airstream generator in said housing operable for generating a primary airstream;

a distribution chamber defined in said housing for receiving the primary airstream from said airstream generator and for redistributing the primary airstream as a first air substream, a second air substream and a third air substream;

a bubbler conduit defined in said housing in fluid communication with said distribution chamber for receiving the first air substream from the distribution chamber and configured for directing the first air substream into the bubble liquid in the reservoir so that the first air substream bubbles through the bubble liquid in the reservoir to create a froth of bubble liquid in said froth chamber;

an exit conduit defined in said housing in fluid communication with said froth chamber, said exit conduit having an outer periphery;

an updraft chimney in said froth chamber in fluid communication with said distribution chamber for receiving the second air substream from the distribution chamber and configured for directing the second air substream against the froth in said froth chamber so as to drive the froth into the exit conduit such that a film of the second air substream driven bubble liquid froth becomes attached to the exit conduit and the second air substream directed against the attached film creates from the attached film and inflates a bubble attached to the exit conduit; and a lift conduit concentrically spaced about the exit conduit for directing the third air substream outwardly from the housing about the exit conduit periphery to facilitate detachment from the exit conduit of the created and inflated bubble attached to the exit conduit and displacement of the detached bubble away from the exit conduit and housing.

17. Apparatus in accordance with claim 16, further comprising a feed tube in said housing for delivering the primary airstream operatively generated by the airstream generator to said distribution chamber.

18. Apparatus in accordance with claim 17, wherein said bubbler conduit further comprises a passageway concentrically defined about an outer periphery of said feed tube for delivering the first air substream from the distribution chamber into the bubble liquid in said reservoir.

19. Apparatus in accordance with claim 16, wherein said housing comprises a handgrip portion graspable by a user, said apparatus further comprising a user-manipulatable actuator on said handgrip portion and connected to the airstream generator for selective user operation of the airstream generator to generate the primary airstream and thereby operate the apparatus to generate and emit a continuous stream of bubbles.

20. Apparatus in accordance with claim 16, wherein said updraft chimney is disposed in substantial alignment with said exit conduit for directing the second air substream toward and into said exit conduit in a first direction, and wherein said lift conduit is oriented for directing the third air substream in said first direction.

* * * * *